United States Patent [19]

Akao

[11] Patent Number: 4,591,681

[45] Date of Patent: May 27, 1986

[54] MICROWAVE OVEN DISPLAY POWER SUPPLY

[75] Inventor: Hideyuki Akao, Osaka, Japan

[73] Assignee: Sharp Kabushiki Kaisha, Osaka, Japan

[21] Appl. No.: 592,354

[22] Filed: Mar. 22, 1984

[30] Foreign Application Priority Data

Mar. 26, 1983 [JP] Japan ..... 58-51194

[51] Int. Cl.[4] ..... H05B 6/66; H05B 39/00

[52] U.S. Cl. ..... 219/10.55 B; 219/506; 315/169.3; 315/DIG. 5; 313/397; 340/760

[58] Field of Search ..... 219/10.55 B, 506; 315/DIG. 5, 169.3, 169.1, 101, 106, 107; 313/397; 340/760; 363/126

[56] References Cited

U.S. PATENT DOCUMENTS 4,158,794 6/1979 Sandler ..... 315/169.1

4,488,089 12/1984 Shota ..... 315/106

*Primary Examiner*—Philip H. Leung

*Attorney, Agent, or Firm*—Birch, Stewart, Kolasch & Birch

[57] ABSTRACT

A fluorescent display tube power supply device of a microwave oven provides a stable power source for the microcomputer by rectifying the output of the first secondary coil of the commercial AC power transformer, followed by rectifying a half wave of the second secondary coil of the same AC power transformer before feeding one-half cycle of the commercial AC current to the heater of the fluorescent display tube. The power supply uses a rectifying circuit for generating the double voltage for the second secondary coil, the double voltage being mixed in the direction in which it becomes lower than the stable voltage of the microcomputer, thus generating the display erase potential VP. As a result, luminance can be held constant respective display positions without causing the voltage of the display tube to vary throughout the ON-OFF operations of the heating power source, thus eventually achieving a highly satisfactory display effect.

8 Claims, 5 Drawing Figures

MICROWAVE OVEN DISPLAY POWER SUPPLY

BACKGROUND OF THE INVENTION

The present invention relates a a fluorescent display power supply device of a microwave oven.

The mechanisms of microwave ovens have become noticeably sophisticated in recent years. Reflecting this, a variety of data display devices are provided for them. Actually, many of these mechanisms use a fluorescent display tube containing a large number of display positions. A fluorescent display tube typically contains an anode which is a display unit itself, a heater emitting electrons to said anode, and grid electrodes controlling electrons. Specifically, such a multi-display-position fluorescent display tube has such a configuration in which a heater is provided in order to commonly cover all display positions, while external terminals extend from the right and the left. As a result, if the heater voltage significantly drops to a critical level from a specific voltage existing between the heater and anode, a difference in luminance will occur in the luminance between the uppermost and the lowest display positions.

A microwave oven performs a cooking by properly controlling the ON-OFF operations of either the microwave heating via magnetron or the radiation heating via the heater in accordance with the instructions of the built-in microcomputer, thus consuming large amounts of power during the heating process. This also causes the output voltage from the power transformer to vary when turning the power ON and OFF for heating operations, thus causing the luminance of the display tube to vary.

A typical circuit diagram of a conventional microwave oven is shown in FIG. 1, except for the power circuit driving the heating device. The commercial AC voltage is first transformed by the power transformer 1, followed by rectifying it into a DC voltage via a rectifying circuit 2 comprising full-wave rectifying diodes D1 through D4 and a capacitor C1, said DC voltage being converted into 100 KHz of high frequency power via an oscillation circuit 3. A secondary coil of high frequency transformer 4 is provided with terminal A for connection to the microcomputer 5, terminal B for the heater potential operating the fluorescent display tube, and terminal C for the cut-off bias of the fluorescent display tube. In addition, a secondary coil for the heater that operates the fluorescent display tube is provided. A DC voltage VDD is generated by a rectifying circuit comprising diode D5 and capacitor C5, which is provided to the microcomputer 5. A mid-range potential VH is then generated by a rectifying circuit comprising diode D6 and capacitor C6 for delivery to the heater, and said potential VH is provided the mid-point of the heater coil, thus causing the display erase potential VP to be generated in the rectifying circuit comprising diode D7 and capacitor C7. The potential VP is then sent to both the anode and grid electrodes of the fluorescent display tube 6 via resistors R4 and R5. The anode electrode of the segment of the fluorescent display tube 6 and the grid electrodes of each display position are respectively connected to the output pins of the microcomputer 5, while each of these electrodes is provided with a ground level according to the contents to be displayed. Potentials thus obtained are shown in FIG. 2, in which, VDD corresponds to −15 V, VH −24 V, and VP −28 V against the ground level VSS, respectively. Difference Ek between the lowest potential of the heater voltage (AC) and the display erase voltage VP is used for the cut-off bias voltage.

As described above, since conventional fluorescent display power supply devices drive heaters by means of high frequencies, any problem related to the difference of the display luminance can be solved. Nevertheless, they still contain complex circuit constructions, in particular, such a high frequency power oscillation circuit adversely affects broadcast receiving equipment. In addition, those conventional circuits need a large number of coil terminals for the power transformer in order to generate the cut-off bias voltage Ek.

OBJECTS AND SUMMARY OF THE INVENTION

The present invention primarily aims at providing a power supply device being totally free from such disadvantages that are inherent to conventional power supply devices as described above, which is capable of constantly ensuring quality display and provides an extremely simplified configuration.

In summary, a preferred embodiment of the present invention provides a stable power source for the built-in microcomputer by rectifying the output the first secondary coil of the commercial AC power transformer, followed by half-wave rectification of the output the second secondary coil of said transformer to feed only one half cycle of the commercial AC current to the heater that drives the fluorescent display tubes. The preferred embodiment includes a circuit for rectifying that doubles the voltage flowing through the second secondary coil in order that the display erase potential VP can be stably obtained by mixing the double potential in the direction so that said double potential becomes lower than the stable voltage being fed to the microcomputer.

The preferred embodiment of the present invention enables the microcomputer to stably operate the display drive circuit by using one half cycle of the rectified current that is not being fed to the heater. At the same time, the present invention also achieves the display erase potential by mixing the rectified DC voltage that doubles the heater coil output with the stable DC potential being fed to the microcomputer. As a result, display positions can always receive well stabilized luminance without causing the display tube voltage to vary throughout the ON-OFF operations of the heating power source. The preferred embodiment of the present invention eliminates the high frequency oscillation circuit and outputs only two kinds of the voltages from the secondary coil of the power transformer, thus effectively achieving a simplified circuit configuration.

DETAILED DESCRIPTION OF THE INVENTION

Figure 1:
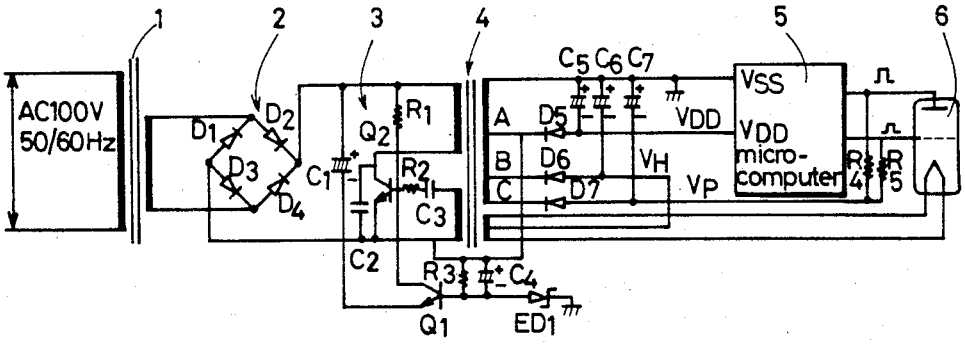
FIG.1 PRIOR ART
FIG. 1 shows a typical diagram of a conventional display power supply circuit.
Figure 2:
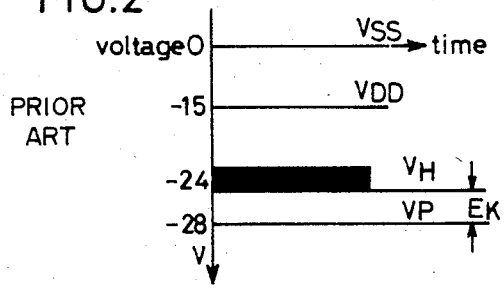
FIG. 2 shows output voltages.
Figure 3:
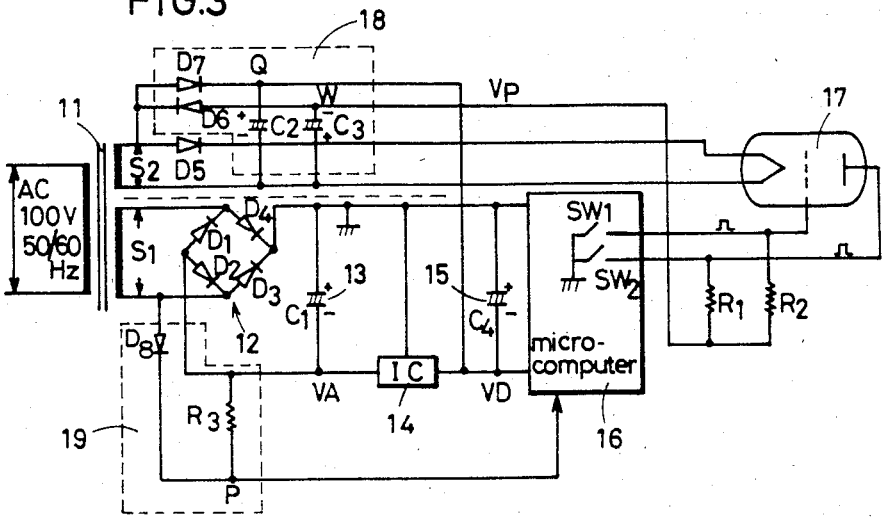
FIG. 3 shows a schematic diagram of the display power supply circuit as a preferred embodiment of the present invention.

FIG. 3 shows a schematic diagram of the display power supply circuit in a preferred embodiment of the present invention. Power transformer 11 of the control circuit receives the commercial AC power source via the primary coil, while said power transformer is also provided with the secondary coil including the first secondary coil S1 and the second secondary coil S2. The output of the first secondary coil S1 rectified by the full-wave rectifying circuit 12 comprising diodes D1 through D4 and capacitor 13 to produce DC voltage VA. A stable DC voltage VD is then produced by the stabilizer circuit 14 and capacitor 15, which is then fed to the power terminal of the microcomputer 16. Said microcomputer 16 incorporates the controller, control programs, and the display register. According to the contents of the display register, both the grid and anode electrodes of the display tube 17 are driven. Said drive mechanism is shown in reference to switches SW1 and SW2 of FIG. 4. A timing detect circuit 19 including diode D8 and resistor R3 is connected to the anode of diode D1 of the full-wave rectifier 12. Since the contact point P between said diode D8 and resistor R3 is connected to the microcomputer 16, said microcomputer 16 can drive the display tube 17 by providing one-half cycle that inhibits the heater current. The second secondary coil S2 is connected to the heater of the fluorescent display tube 17 via the half-wave rectifier diode D5. A double voltage rectifier circuit 18 is formed by diodes D6 and D7 together with capacitors C2 and C3, while the positive electrode Q of said circuit 18 is connected to the stabilized DC potential $V_D$ whereas the negative electrode W is connected to both the anode and grid electrodes of the display tube 17 via resistors R1 and R2. Potential of said negative electrode is denoted by VP.

Figure 4:
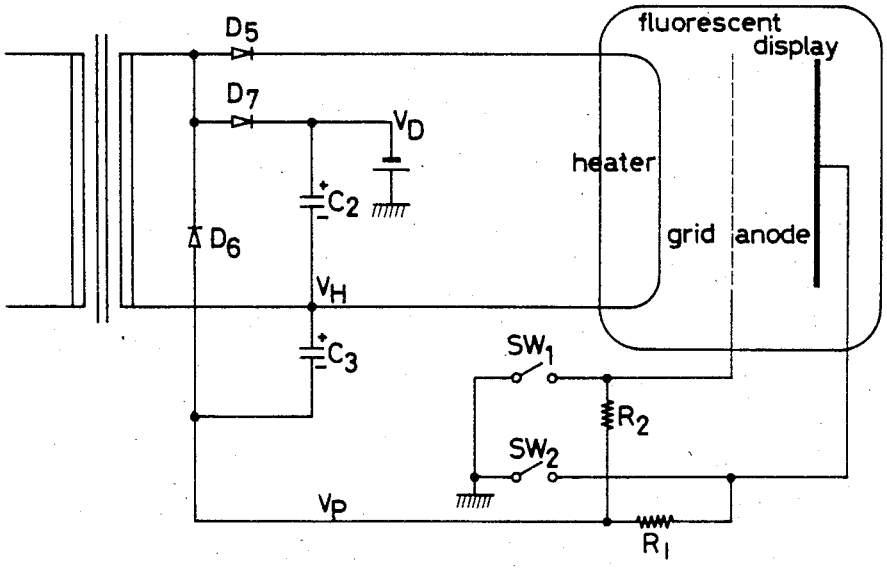
FIGS. 4 and 5 respectively show functional charts of the display power supply circuit shown in FIG. 3.
Figure 5:
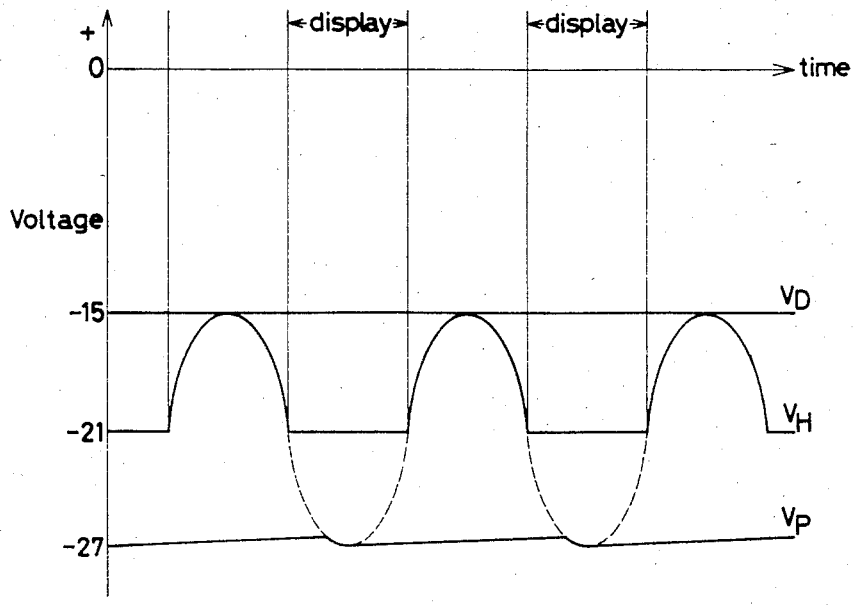

FIG. 4 shows the key part of the circuit diagram extracted from FIG. 3. FIG. 5 shows waveforms of voltages. In reference to these, circuit operations are described below. The heater of the display tube 17 receives current being half-wave-rectified by diode D5, and so said heater can be heated every one-half cycle. However, electrons are being emitted even during the other half cycles in which no current is fed to the heater. When the latter half cycle exists with no power being fed, switches SW1 and SW2 are activated to perform the needed display operations. Capacitor C3 of the double voltage rectifying circuit is charged when the one-half cycle exists with no power being fed to the heater, whereas capacitor C2 is charged when the other half cycle exists with the power being fed to the heater. Output voltage $V_D$ of the stabilizer circuit 14 is shown in terms of a battery. When such a one-half cycle exists with no power being fed to the heater, the heater potential is constant independent of the display positions, i.e., the state of said heater potential VH is represented by a formula VH=D−VC2, where VC2 is the terminal voltage of capacitor C2. When this condition exists, the voltage being fed to both the anode and grid electrodes of the display tube 17 is represented by a formula VP=VD−VC2−VC3, where VC3 is the terminal voltage of capacitor C3. As a result, during such a one-half cycle in which the display is being performed with no power being fed to the heater and both switches SW1 and SW2 being OFF, the anode and grid electrodes of the display tube will respectively remain in the stable potential VP. Since this potential VP is always lower than the heater potential VH when no power being fed, display is correctly erased. In this condition when the switches SW1 and SW2 are switched on while no power is being fed to the heater, both the anode and grid potentials respectively rise up to the ground level as shown by dashed lines in FIG. 5, thus causing them to reach a level higher than the heater potential VH, and as a result, fluorescent material on the anode stably illuminates.

What is claimed is:

1. A microwave oven comprising:

a power supply receiving commercial AC voltage;

microwave generating means, powered by said power supply, for developing microwave energy;

a fluorescent display displaying information at a plurality of display positions, said fluorescent display including a heater, an anode, and grid means for erasing a display state of said fluorescent display at selected display positions;

control means, driven by said power supply, for controlling the application of voltage to said anode and grid means of said display;

said power supply including, a rectifier for converting said commercial AC voltage to supply DC power to said control means, means for rectifying said commercial AC voltage to form a rectified half-wave voltage, means, responsive to said means for rectifying, for supplying only one-half cycle of said rectified voltage to said heater of said fluorescent display, voltage doubling means, responsive to said means for rectifying, for doubling said rectified voltage to form a display erase potential having a magnitude greater than the magnitude of said rectified voltage supplied said heater by said means for supplying;

said control means controlling the supply of said display erase potential to said anode and grid means to selectively erase display positions of said fluorescent display to display information at other selected display positions.

2. The oven of claim 1 wherein said fluorescent display displays digit information.

3. The oven of claim 1 wherein said power supply includes a power transformer connected between a source of commercial AC voltage and said means for rectifying.

4. The oven of claim 1 wherein said display erase potential is a negative voltage.

5. The oven of claim 1 wherein said control means is a microcomputer.

6. The oven of claim 1 wherein said control means selectively grounds portions of said grid means associated with said selected display positions to provide a display of said display information.

7. The oven of claim 6 wherein said control means is a microcomputer.

8. The oven of claim 1 wherein said grid means and anode are driven during a half-cycle of said commercial AC voltage alternate to the one-half cycle supplied to said heater by said means for supplying.

* * * * *